United States Patent [19]

Rambold

[11] 4,154,853

[45] May 15, 1979

[54] PACKED INFUSIBLE BAG FOR AN INFUSIBLE SUBSTANCE

[76] Inventor: Adolf Rambold, Bachstrasse 8, D-4005 Meerbusch 1, Fed. Rep. of Germany

[21] Appl. No.: 854,350

[22] Filed: Nov. 23, 1977

[30] Foreign Application Priority Data

Dec. 3, 1976 [DE] Fed. Rep. of Germany ..... 2654867

[51] Int. Cl.[2] ..... B65B 29/04

[52] U.S. Cl. ..... 426/83; 206/0.5; 426/110; 426/115

[58] Field of Search ..... 426/77–84, 426/112, 115, 122, 123, 110; 206/0.5, 629, 804

[56] References Cited

U.S. PATENT DOCUMENTS

| | | | |
|---|---|---|---|
| 2,087,236 | 7/1937 | Anders | 426/81 |
| 2,103,389 | 12/1937 | Salfisberg | 426/115 |
| 2,248,266 | 7/1941 | Abrams | 426/122 |
| 2,413,686 | 1/1947 | Barnett | 426/82 |
| 3,008,837 | 11/1961 | Kaplan | 426/110 |
| 3,175,911 | 3/1965 | Rambold | 426/83 |
| 3,185,578 | 5/1965 | Scharre | 426/122 X |
| 3,223,229 | 12/1965 | Welin-Berger | 426/83 X |
| 3,692,536 | 9/1972 | Fant | 426/83 X |

FOREIGN PATENT DOCUMENTS

| | | | |
|---|---|---|---|
| 116221 | 12/1942 | Australia | 426/83 |
| 724499 | 12/1965 | Canada | 426/84 |
| 962038 | 6/1964 | United Kingdom | 206/0.5 |

*Primary Examiner*—Steven L. Weinstein
*Attorney, Agent, or Firm*—Martin A. Farber

[57] ABSTRACT

A packed infusible bag for an infusible substance with an inner bag, which contains the substance, made of a liquid-permeable material, a string secured to the head of the bag and a packing envelope made of a liquid- and air-impermeable material surrounding the bag on all sides, with the envelope having an edge part formed of two sealed material layers enclosuring the free end of the string. The edge part bounds a hollow space of the envelope in which the bag is received, and a tag is connected via the string with the head of the bag for handling of the bag and the tag is separable from the remainder of the envelope along a separating line which leaves the string untouched. With a hermetically sealed envelope, the separating line extends in the edge part, in part closely adjacent to the hollow space, such that between the tag and the hollow space, a narrow stay is formed which can be separated by hand transversely to the regional running direction of the separating line.

9 Claims, 7 Drawing Figures

Fig. 5.
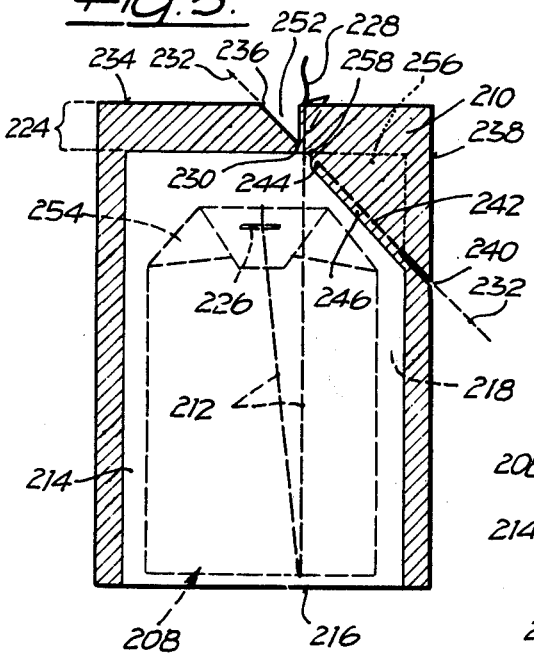
Fig. 6.
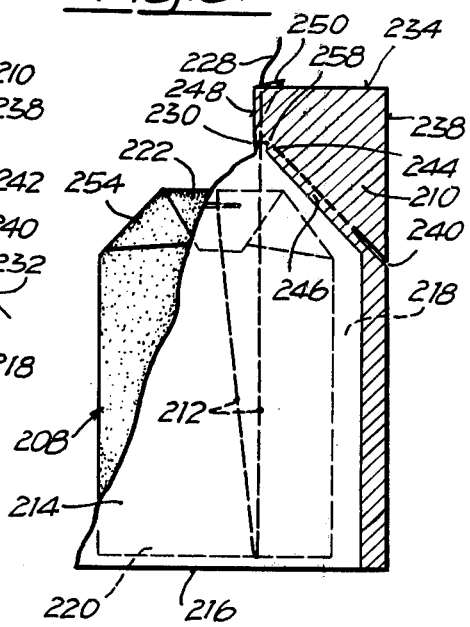
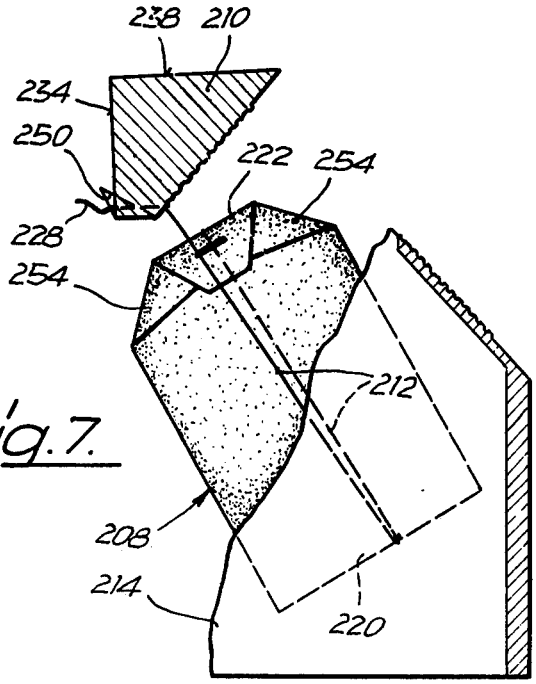
Fig. 7.

PACKED INFUSIBLE BAG FOR AN INFUSIBLE SUBSTANCE

The invention relates to a packed infusible bag for an infusible substance as tea, with an inner bag which contains the substance made of a liquid-permeable material, a string secured to the head of the bag and a packing envelope made of a liquid-impermeable and air-impermeable material surrounding the bag on all sides, the envelope having an edge part formed of two heat-sealed or glued-together material layers with enclosure of the free end of the string, the edge part bounding a hollow space of the envelope in which space the bag is received, and a tag connected via the string with the head of the bag for handling of the bag, which tag is separable from the remainder of the envelope along a separating line which leaves the string untouched.

With an immersible bag of this type known from Austrian Pat. No. 239,134 (FIG. 8) the separating line marked by a perforation runs along the boundary between the hollow space which is formed by the envelope, in which hollow space the inner bag is located, and the tag, after the separation of which along the tear line formed by the perforations, the envelope is opened so that the bag can be removed on the string from the envelope without more. A serious disadvantages of this per se advantageous course of the separating line resides in that the perforation-holes connect or communicate the hollow space with the ambient air, and as a result of this, atmospheric air which entered into the hollow space penetrates through the air-permeable material of the inner bag to the substance contained therein and disadvantageously influences the latter. This unfavorable influence for example with tea is a taste impairment by evaporation of the essential or volatile oils contained in it, which cannot escape from a hermetically sealed envelope. Such an envelope yet gives difficulties with the removal of the inner bag.

It is an object thus on which the present invention is based to provide a packed immersible bag of the introductory-mentioned type which protects the immersible substance contained in it against the entrance of air and liquid and simultaneously permits a convenient removal of the inner bag.

It is another object of the present invention to aid the solution of the above-mentioned object in the manner that, with a hermetically sealed envelope (14; 114; 214) the separating line (32; 132; 232) extends in the edge part (shaded) in part closely adjacent to the hollow space (18; 118; 218) such that between the tag (10; 110; 210) and the hollow space, a narrow web or stay (46; 146; 246) exists which can be separated by hand transversely to the regional running direction of the separating line. The stay guarantees the known per se hermetic sealing of the envelope and its narrowness permits the tearing of the envelope at any place of the stay in order to uncover the inner bag. During the tearing of the envelope of course it may not be stopped after the separation of the stay, but rather the envelope must be torn in two parts so that the bag can be removed from one side of the envelope.

With a preferred embodiment of the packed immersible bag according to the invention it is proposed that the envelope comprises a rectangular, tearable strip of material which is folded along a center line, which strip is layered or coated at least half on the inner sides of its free edges with a heat and/or pressure activateable material for adhesively connecting the free edges of both strip halves which lie on one another, and its ends form the edge part of the envelope, and has a perforated tear line at least partly constituting the separating line. The envelope of the known immersible bag is similarly formed; its perforated tear line forms the entire separating line. Differing therefrom the preferred embodiment form of the present invention is characterized in that the tear line (42; 142; 242) runs only on one side of the enclosed string end (28; 128; 228) and terminates at the string (12; 112; 212) and that the separating line (32; 132; 232) is formed partly by a first cut or slit 36; 136; 236) in the edge part of the envelope which terminates at a point (30; 130; 230) of the separating line which point corresponds at least approximately with that end point (44; 144; 244) of the tear line which is mirror-imaged (plane symmetry) relative to the string. In this manner then if the separating line is straight at least section-wise as with the known immersible bag and at least on its one end stands perpendicularly to the outer edge of the envelope, the first cut (36) can be guided under an angle of less than 180 degrees and more than 90 degrees to the tear line (42), and the string (12) can extend perpendicularly relative to the tear line from the outer edge (34) of the envelope (the outer edge lying parallel to the tear line) up to the separating line (32); or if the separating line is straight as with the known immersible bag, with a bag head (222) with a folded-back corner (254), the tag (210) can form a corner of the edge part of the envelope, which corner is adjacent to the bag head. In both cases by the subdivision of the separating line into a tear line and an inclined first cut, which subdivision is marked by the string, it is advantageously achieved that the corner of the envelope which has the tag can be held with one hand and the corner of the envelope which lies opposite thereto at the same height can be pulled to that opposite corner of the envelope which lies diametrically opposite the tag. When this occurs the envelope tears on one side so that the bag can be withdrawn on this side from the envelope.

With the preferred embodiment the first cut (36; 136; 236) and a fold line (48; 148; 248) in the edge part of the envelope (14; 114; 214), which fold line runs parallel to the string (12; 112; 212), demarcate a small corner (50; 150; 250) from the remaining edge part, which small corner is folded back on the latter and thereby forms a triangular recess (52; 152; 252) in the edge part of the envelope. The recess, which is easily producible by folding back the small corner, indicates to the user of the packed immersible bag according to the invention at which position he should begin tearing the envelope and which parts of the envelope including the tag are determined and suitable for this, to be grabbed by both hands.

The preferred embodiment forms are provided with a second cut (40; 140; 240) in the edge part of the envelope (14; 114; 214), which second cut forms the separating line (32; 132; 232) from the tear line (42; 142; 242) up to the outer edge (38; 138; 238) of the edge part of the envelope. In this manner the separation of the tag is facilitated from the remaining part of the envelope since the separation at the separating line is already consummated along the second cut.

In case the string as with the preferred embodiment runs tight from the head (22; 122; 222) of the bag (8; 108; 208) to its bottom (20; 120; 220) which it goes around, and from the latter up to the tag (10; 110; 210), the production of the packed immersible bag according to the invention may be considerably simplified, which would be more difficult with an uncontrolled string course.

With the above and other objects and advantages in view, the present invention will become more clearly understood in connection with the following detailed description of preferred embodiments, when considered with the accompanying drawings, of which:

FIG. 5 is a plan view of the wide side of a third embodiment corresponding to FIGS. 1 and 4;

FIG. 6 is a view similar to FIG. 5 after tearing off a part of the envelope corresponding to FIG. 2; and FIG. 7 is a view similar to FIG. 6 after separation of the tag during the lateral removal of the bag corresponding to FIG. 3.

Figure 1:
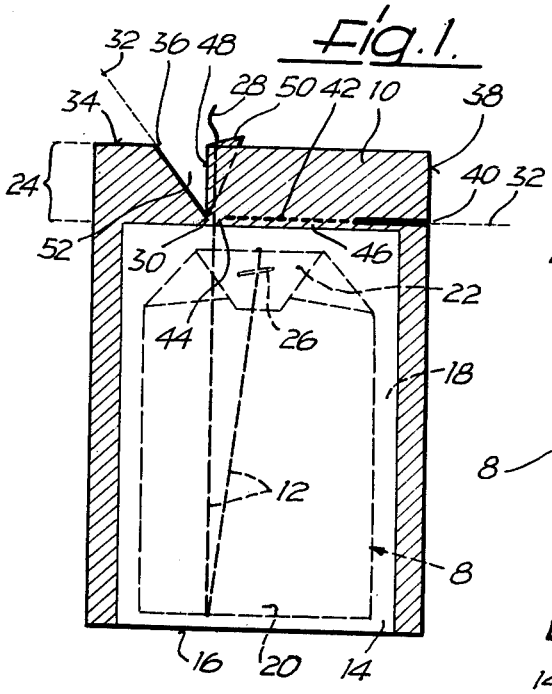
FIG. 1 is a plan view of the side of a first embodiment of the invention.
Figure 2:
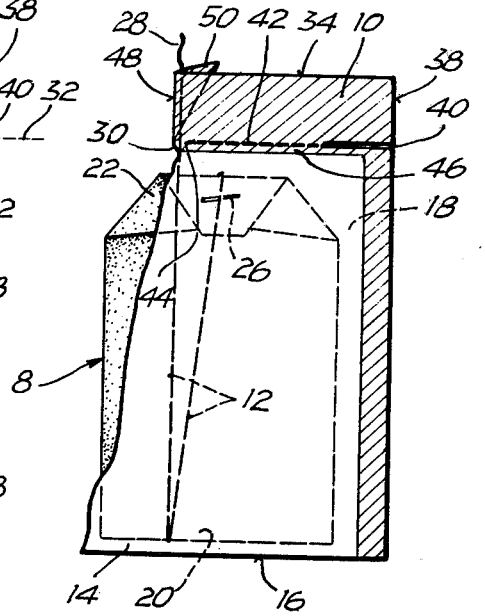
FIG. 2 is a view of the packed immersible bag of FIG. 1 after tearing off a part of the envelope.
Figure 3:
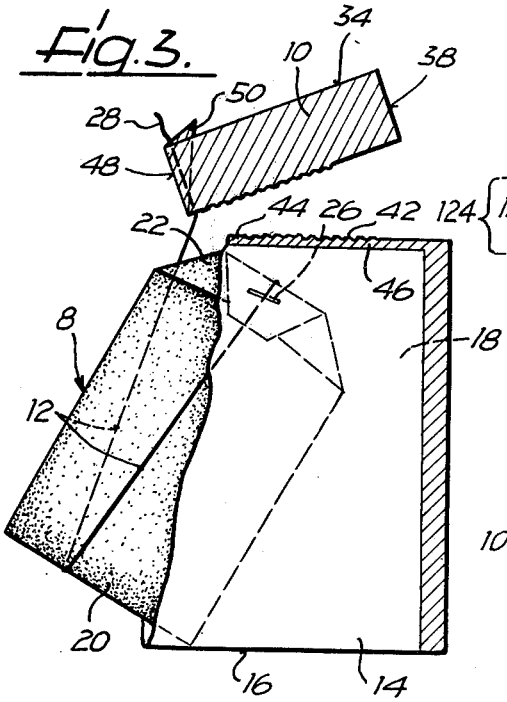
FIG. 3 is a view similar to FIG. 2 after separation of the tag during the lateral removal of the bag.

The first embodiment according to FIGS. 1–3 essentially comprises an inner bag 8 made of filter paper containing for example tea or another immersible substance, a tag 10 serving as a label for handling of the bag 8, a string 12 which connects the tag 10 with the bag 8 and an outer envelope or casing 14. The flat envelope 14 which is rectangular in plan view is produced in the manner that an elongated, thin, rectangular strip made of a three layered sandwich or composite material has been folded together along its shorter center line 16. On three sides, with the exception of the side formed by the center line 16, respectively, the free edges which lie on one another of both of the congruent strip halves have been hermetically connected, whereby a rectangular frame arises, which is made conspicuous in the drawing by shading. This frame is formed and arranged symmetrically to the longitudinal center line of the strip, the frame bounding a hollow space 18 on the three named sides, which hollow space is also rectangular in plan view and contains the bag 8 therein. The sandwich material comprises a (cellulose-) paper forming the outer side of the envelope 14, an aluminum foil (sheet aluminum) arranged in the middle and a thermoplastic (polyethylene-) foil by which the afore-mentioned strip halves were bonded or welded together air-tightly and liquid-tightly in the shaded, closing or sealing zones by means of heat- and pressure- action.

The immersible bag 8 is disposed in the hollow space 18 such that its bottom 20 is located adjacent the shorter fold- and center- line 16, while its head 22 lies opposite to the processed, horizontal upper section 24 of the illustrated shaded edge part of the envelope 14. One of the ends of the string 12 is fastened on both sides on the head 22 of the bag 8 by means of a clip or staple 26. The string runs taught from the head 22 of the bag up to its bottom 20, where it turns therearound, and runs from the latter perpendicularly relative to the fold- and center- line 16 parallel to the longer center line of the strip which forms the envelope, up into the section 24 of the shaded edge part of the envelope and out beyond that. The other end, that is the string end 28 which is not fastened on the bag head, is embedded in the section 24, in the manner that the thermoplastic foil of the connecting material at an area thereat hermetically surrounds the string 12.

The tab 10 is a part of the section 24 of the shaded edge part of the envelope 14. It has been produced in the manner that along a moreover straight separating line 32 which is inclined (at the right side of FIG. 1) relative to the upper outer edge 34 of the envelope 14, the separating line 32 being angled at a spot 30 closely adjacent to the string 12 and to the hollow space 18, there leads a first cut 36 and a second cut 40 perpendicular to the right outer edge 38 of the envelope 14 in FIG. 1; and by means of perforations the remaining center section of the separating line 32 is formed into a tear line 42 which terminates at a spot 44 (inner end point) coincides with the mirror image type line symmetry of the spot 30 (inner first point) relative to the string 12, i.e., the points 44 and 30 being equidistant from both sides of the string. The spacing of the spots 30 and 44 from one another and the width of the narrow web 46 which exists between the tear line 42 and the hollow space 18 (the stay 46 itself being made of bonded or sealed composite material) are only approximately one to two millimeters large, so that on the one hand the hollow space 18 remains hermetically sealed, and on the other hand for detaching the string 12 from the laterally opened envelope 14, only a small expenditure of force or effort is required. From the spot 30 up to the outer edge 34, there extends a fold line 48 which runs perpendicular thereto and parallel to the string 12, which fold line 48 together with the cut 36 separates a small corner 50 from the section 24 of the shaded edge part of the envelope 14. The small corner 50 is folded rearwardly along the fold line 48 in the direction of view according to FIG. 1.

For opening of the envelope 14, the right upper corner of the envelope is held fast with the right hand, and the left upper corner is seized with the left hand, which left upper corner positively lifts off from the tab 10 by means of the triangular recess 52 (the latter being defined by the cut 36 and the fold line 48), whereupon the left upper corner is pulled until it steps in front or behind the plane of the drawing of FIG. 1 and the envelope 14 is torn through from the spot 30 up to the left lower corner. After throwing this torn-off portion away, the bag 8 already projects from the torn envelope 14, as shown in FIG. 2. For handling the bag, the remaining residual portion of the envelope is now held with one hand, until the other hand grabs the right end of the tag 10 and separates the latter by tearing from right to left of the already opened envelope 14 according to the direction of view of FIG. 2, whereby the web 46 is also torn at the spot 44. The tag 10 and the string 12 are now free according to FIG. 3 and can serve to pull the bag 8 out from the laterally left side opened envelope 14. During immersion, the bag, tag and string cooperate in known manner.

Figure 4:
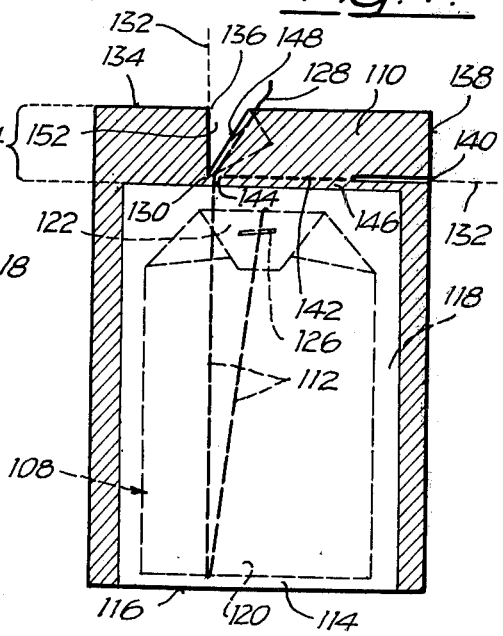
FIG. 4 is a view of a second embodiment of the invention according to FIG. 1 in corresponding illustration.

The second embodiment according to FIG. 4 corresponds essentially with the first embodiment, whereby the parts of the second embodiment which correspond or are the same as those of the parts of the first embodiment have the same reference numbers however raised by 100.

With this second embodiment, the first cut 136 extends vertically or perpendicularly to the upper outer edge 134 of the envelope 114. As a consequence of this, for the formation of the triangular recess 152, an inclined fold line 148 must be chosen; the thread end 128, which likewise extends inclined to the outer edge 134, is disposed parallel to this fold line 148.

Parts of the third embodiment according to FIGS. 5–7 which correspond to or are the same as that of the first or second embodiments are numbered with the same reference nummerals however increased by 200 and 100, respectively.

The third embodiment form according to FIGS. 5–7 differs from the two other embodiments in the manner that the separating line 232 extends through continuously straight along a single line and extends inclined to the upper outer edge 234 as well as to the right outer edge 238, and that the tab 210 forms a corner of the shaded edge part of the envelope 214, which corner is adjacent to the bag head 222 which in turn is provided with the folded-back corner 254, which tab with a reduction of the hollow space 218 for enlargement of the tag 210 is provided with an additional substantially triangular area 256. The triangular area 256 as shown in FIG. 5 is enclosed or framed by the two mutually perpendicular dashed lines and the inner limit line of the web 246. The left upper corner of the area 256 has not been formed or developed, in order to make possible there the perpendicular or vertical entrance of the string 212 into the section 224 of the shaded edge part of the envelope 214, the string 212 running upwardly in this embodiment at the right side of the longer center line of the strip of material which forms the envelope 214. In other words, the hollow space 218 pushes forward to the spot 258 with a right angle apex up to alignment with the separating line 232. The spot 258 on the separating line 232 has approximately the same distance relative to the string 212 and relative to the spot 244. The end 228 of the string runs between the points 230 and 258.

The second cut 240 terminates approximately where the additional area 256 of the shaded edge part of the envelope 214 begins.

The formation of the folded-back small corner 250 and the corresponding recess 252 is thus as in accordance with the first embodiment according to FIG. 1. Its arrangement, however, is met such that it is not at the left (as in FIG. 1), but rather at the right (as FIG. 5 shows) of the longer center line of the strip of material which forms the envelope 214. Keeping this arrangement it also would be possible to provide the formation of a small corner and recess not as in FIG. 1, but as shown in FIG. 4.

For opening the envelope 214 and for removal of the bag 208, as in both of the other embodiment examples previously described, reference is made to the time succession of FIGS. 5, 6 and 7, sequentially, which constitute the conditions of the operation corresponding to FIGS. 1, 2 and 3, respectively.

While I have disclosed several embodiments of the invention, it is to be understood that these embodiments are given by example only and not in a limiting sense.

I claim:

1. A packed infusible bag for an infusible substance such as tea, comprising an inner bag containing an infusible substance and made of a liquid-permeable material, a string secured at one end to the head of the bag, a packing envelope made of a tearable liquid and air-impermeable material surrounding the bag on all sides, said material is folded along a center line defining two strip halves having free edges, said free edges of said two strip halves forming two facing abutting inner sides, respectively, said material being layered at least on one of said two facing abutting inner sides of said free edges with a heat and/or pressure activateable material sealingly connecting said free edges of both said two strip halves which lie on one another and defining and maintaining a hermetically-sealed hollow space therein in which said bag is disposed, a portion of said sealed free edges form an envelope edge part of said envelope, said envelope edge part sealingly enclosing the other end of the string therebetween, said edge part bounding a portion of said hermetically-sealed hollow space in the envelope, a tag is connected via said string with the head of the bag for handling of the bag, said tag constituting an integral part of said envelope edge part and separably connected from a remainder of said envelope edge part along a separating line formed exclusively in said edge part starting from different outer edges of said envelope edge part on opposite sides of the enclosed end of said string and extending from said different edges on said opposite sides up to but spaced apart from said enclosed end of said string and closely adjacent to said hollow space, such that the area of said envelope edge part immediately adjacent both sides of said enclosed end of the string is sealed a portion of said separating line extending in said edge part along and closely adjacent to said hollow space defining a narrow web between said tag and said hollow space, said narrow web constituting a portion of said envelope edge part, at least a portion of said separating line and said portion of said separating line constituting a perforated tear line, said perforated tear line starting from at least adjacent one of said different outer edges and extends exclusively in said envelope edge part on one of said opposite sides of said enclosed end of said string up to an inner end point of said tear line in said envelope edge part on said one opposite side of said enclosed end of said string, said end point being spaced from said string on said one opposite side, another portion of said separating line being defined by at least one first cut starting from another of said different outer edges and formed and extending exclusively in said envelope edge part on the other of said opposite sides of said enclosed end of said string up to an inner first point of said another portion of said separating line in said envelope edge part and directed toward the sealed hollow space such that thereby the envelope can be torn through the hollow space, said inner first point being spaced from said string on said other opposite side of said enclosed end of said string, said inner first point on said other opposite side of said enclosed end of said string corresponds, at least approximately, line symmetrically relative to said string with respect to said inner end point of said tear line in said envelope edge part on said one opposite side of said enclosed end of said string, said inner end point of said tear line and said inner first point of said at least one first cut defining an imaginary straight line therebetween exclusively in said envelope edge part through said area, whereby said tear line can be torn from said one edge to said inner end point and across said narrow web to said hollow space and the torn-through envelope to release the tag so that the bag and tag can be removed from the envelope.

2. The packed infusible bag as set forth in claim 1, wherein said first cut forms an angle less than 180 degrees and more than 90 degrees relative to said tear line, said string extends perpendicularly relative to said tear line from an outer edge of said envelope up to said separating line, said tear line extends parallel to said outer edge.

3. The packed infusible bag as set forth in claim 1, wherein said separating line is straight, said head of said bag has a folded-back corner, said tag forms a corner of said edge part of said envelope, said corner is adjacent to said head of said bag.

4. The packed infusible bag as set forth in claim 3, wherein said first cut extends along said separating line, said string runs parallel to an elongated outer edge of said edge part of said envelope, said tear line is inclined relative to said string.

5. The packed infusible bag as set forth in claim 1, wherein said envelope is formed with a fold line in said edge part of said envelope, said fold line runs parallel to said string, the latter is enclosed in said edge part adjacent said fold line, said first cut and said fold line demarcate a small corner from the remainder of said edge part, said small corner is folded back on said remainder of said edge part and thereby forms a triangular recess in the edge part of said envelope.

6. The packed infusible bag as set forth in claim 1, wherein said edge part of said envelope is formed with a second cut, said second cut forms said separating line from said tear line up to an outer edge of said edge part of the envelope.

7. The packed infusible bag as set forth in claim 1, wherein said separating line is straight at least at a section thereof and at least on one end is perpendicular to an outer edge of said envelope, said first cut is perpendicular relative to said tear line, said string extends from said outer edge of said envelope to said separating line at an angle of less than 90° relative to said tear line, the latter extends parallel to said outer edge.

8. The packed infusible bag as set forth in claim 1, wherein said string extends tightly from said head of said bag to a bottom of said bag, said string continues around said bottom and from the latter extends up to said tag, said separating line is straight at least in a section thereof and at least on one end is perpendicular to an outer edge of said envelope, said first cut is perpendicular relative to said tear line, said string extends from said outer edge of said envelope to said separating line at an angle of less than 90° relative to said tear line, the latter extends parallel to said outer edge.

9. The packed infusible bag as set forth in claim 1, wherein said string extends tightly from said head of said bag to a bottom of said bag, said string continues around said bottom and from the latter extends up to said tag, said string runs parallel to an elongated outer edge of said edge part of said envelope, said tear line is inclined at an angle other than perpendicularly relative to said string.

* * * * *